US010458122B2

(12) United States Patent
Bodner

(10) Patent No.: US 10,458,122 B2
(45) Date of Patent: Oct. 29, 2019

(54) PAPERBEAD FOR PROTECTING DRYWALL CORNERS

(71) Applicant: BAILEY METAL PRODUCTS LIMITED, Concord (CA)

(72) Inventor: Stephen Bodner, Sherwood Park (CA)

(73) Assignee: Bailey Metal Products Limited, Concord, ON ( * ) Notice: Subject to any disclaimer, the term of this patent is extended or adjusted under 35 U.S.C. 154(b) by 286 days.

(21) Appl. No.: 15/449,435

(22) Filed: Mar. 3, 2017

(65) Prior Publication Data

US 2018/0251984 A1 Sep. 6, 2018

(51) Int. Cl.
*E04F 13/06* (2006.01)
*E04F 19/06* (2006.01)
*E04F 19/02* (2006.01)

(52) U.S. Cl.
CPC ..... *E04F 13/06* (2013.01); *E04F 19/022* (2013.01); *E04F 19/06* (2013.01); *E04F 19/064* (2013.01); *E04F 19/028* (2013.01); *E04F 2013/063* (2013.01)

(58) Field of Classification Search
CPC ... E04F 2013/063; E04F 13/04; E04F 13/047; E04F 13/06; E04F 13/068; E04F 19/061; E04F 19/028
USPC ..... 52/254, 256, 255, 287.1
See application file for complete search history.

(56) References Cited

U.S. PATENT DOCUMENTS 5,131,198 A 7/1992 Ritchie et al.
5,613,335 A 3/1997 Rennich et al.
5,836,122 A 11/1998 Rennich et al.
6,358,309 B1 * 3/2002 Langford ..... C04B 26/02 106/661
6,655,101 B2 * 12/2003 Harel ..... B32B 15/14 52/287.1
7,137,231 B2 11/2006 Harel
(Continued)

FOREIGN PATENT DOCUMENTS

CA 2212854 2/2001
CA 2471325 3/2012

*Primary Examiner* — Phi D A

(57) ABSTRACT

The present invention relates to drywall paperbeads, particularly drywall paperbeads for use in protecting exposed drywall surfaces having non-planar surface contours in an edge region adjacent the drywall edges. The paperbead includes an elongated core having an inner surface and an outer surface, an elongated paper strip having an inner surface and an outer surface, a thickness of between 6 and 7 mils, a weight of between 110 and 125 grams/square meter (gsm) and a porosity of 30 to 130 Gurley sec. The inner surface of the paper strip is roughened and bonded to the outer surface of the core. The outer portion of the thickness of the paper strip is impregnated with a strengthening compound, preferably a polymer strengthening compound, more preferably a latex strengthening compound in an amount of between 3.5% and 13% of the total weight of the paper strip. The width of the paper strip is greater than the width of the core such that at least one edge of the paper strip extends laterally beyond the edge of the core to form a wing on at least one edge of the paperbead. The wing of the paper strip of the paperbead follows the non-planar surface contour of the drywall in the edge region adjacent the drywall edge.

24 Claims, 6 Drawing Sheets

(56) References Cited

U.S. PATENT DOCUMENTS

| | | | | |
|---|---|---|---|---|
| 7,214,434 | B2 * | 5/2007 | Dalgleish | E04F 13/06 162/164.1 |
| 9,388,582 | B1 * | 7/2016 | Smythe | E04F 19/028 |
| 9,435,124 | B2 * | 9/2016 | Bezubic, Jr. | B28B 1/526 |
| 9,446,546 | B1 * | 9/2016 | Wambaugh | B29C 47/04 |
| 9,764,527 | B2 * | 9/2017 | D'Anglade | B65D 81/054 |
| 2002/0073639 | A1 * | 6/2002 | Kunz | E04F 13/06 52/255 |
| 2003/0033770 | A1 * | 2/2003 | Harel | B32B 15/08 52/287.1 |
| 2003/0089058 | A1 * | 5/2003 | Kunz | E04F 13/06 52/255 |
| 2011/0023392 | A1 * | 2/2011 | Rosenthal | E04F 13/06 52/255 |
| 2014/0123581 | A1 * | 5/2014 | Ward | E04F 13/068 52/287.1 |

* cited by examiner

PAPERBEAD FOR PROTECTING DRYWALL CORNERS

FIELD OF THE INVENTION

The present invention relates to the use of drywall paperbead for protecting exposed edges of drywall, particularly for use in protecting drywall edges where the drywall surface adjacent the edges has a non-planar contour.

BACKGROUND OF THE INVENTION

Current building construction techniques frequently call for the use of drywall sheets, otherwise called wallboard, to form the surfaces of interior walls. Sheets of drywall are made by encasing sheets of plaster with heavy construction paper. The paper provides extra strength and resistance to tearing and prevents crumbling of the enclosed plaster. The sheets of drywall are typically produced in sizes of four feet by eight feet to four feet by twelve feet. These sheets can be installed intact or can be cut to custom fit specific interior wall sizes. When cut, the inner plaster is exposed and is particularly vulnerable to crumbling or other damage unless the severed edges can be protected. An exposed corner, exterior or interior, formed by two interfacing drywall sheets not in the same plane is also susceptible to damage. Damage can be particularly severe when these corners involve cut or exposed edges. To overcome this vulnerability to damage and further reinforce exposed edges, particularly the exposed corner formed by two interfacing drywall sheets, a drywall trim such as a drywall corner bead will generally be installed at that corner. The corner being reinforced can be either an interior or exterior corner.

Two types of drywall trim are typically used in protecting exposed edges and reinforcing drywall corners—a paper-faced bead type (also known as a paperbead), and a solid all-metal or all plastic drywall trim type. Both the paperbead and the solid drywall trim typically include a strip of metal or plastic formed or extruded into a desired shape. One common example involves forming the metal or plastic strip into a core shape having two flanges and a center rib positioned between them. This form of drywall trim is called a rib-shape corner bead. Another common shape of drywall trim has two flanges and a larger curved portion or bullnose positioned between them. This shape of corner bead is called a bullnose corner bead. A third shape of drywall trim features an L-shape having one flange longer than the other and an offset rib between the flanges. Other common shapes of drywall trim include a J-shape, a splay-bead, and a shadow-mold.

Solid drywall trims such as a rib-shape corner bead are attached to drywall by driving nails, screws, staples or other fasteners through the flanges, securing the drywall trim with the heads of the fasteners to the underlying framing. A joint compound is then applied to cover the flanges and fastener heads. The compound is sanded and feathered to provide a smooth and continuous surface from the drywall surface to the center rib of the formed metal strip.

Paperbeads provide several advantages over solid drywall trims. For instance, both joint compound and paint adhere significantly better to the surface of a paperbead than to the exposed metal or plastic surface of a typical solid drywall trim. Moreover, paint applied directly to a metal or plastic surface is easily chipped after drying. Drywall corners covered with solid drywall trims are also more susceptible to cracking along the edges of the flanges. Thus, a paperbead provides a better surface for joint compound and paint adhesion and helps reduce plaster cracking.

Paperbeads differ from solid drywall trims in several respects. First, the paperbead has a paper strip attached to an outer surface of the formed metal or plastic core as previously discussed. Generally, portions of the paper strip extend beyond the edges of the metal or plastic core forming wings. The paperbead is attached to drywall by applying a joint compound to the drywall surface and embedding the formed metal strip and the paper wings in the compound. A second, exterior layer of joint compound is subsequently applied on top of the paperbead and allowed to dry. This exterior layer of joint compound is then sanded and feathered to form a smooth and continuous surface between the drywall and the corner bead. The steps of applying, sanding and feathering the exterior layer of joint compound can be repeated until a smooth surface is created. Throughout this process, the portion of the paper strip covering the core of the drywall trim, i.e. the center rib, the bullnose, or the offset rib, is left exposed or uncovered by joint compound.

The paper surface left exposed on a typical paperbead may be scuffed, or completely removed during the sanding and feathering process, thus exposing the metal surface of the core beneath. Scuffing makes it more difficult to later obtain a smooth painted surface at the paperbead because the paper becomes frayed or fuzzy. Also, as stated previously, paint does not adhere as easily to the exposed metal surfaces. Therefore, paint applied to any exposed metal surface will be more easily chipped after it dries. Moreover, a scuff in the paper surface produces a break in the line of the paperbead and reduces the aesthetic benefits of having such a bead.

To overcome the problems of scuffing, some paperbeads provide a surface coating at the exposed center portion of the paperbead to improve the paper's resistance to abrasion and avoid the problems caused by scuffing. This type of surface coated paperbead is disclosed in U.S. Pat. No. 5,131,198. A surface coating, however, only provides extra resistance to abrasion at the outer surface of the paper strip. If this coating is penetrated or removed by the sanding process, the underlying paper is exposed and is again made susceptible to scuffing. Consequently, the problems of paint adhesion, unsmooth surface finishes and, paint chipping are not avoided. Moreover, the application of a surface coating at a particular location involves an additional installation step thereby increasing the cost of installing the product.

To resolve the problem of surface coated paper, U.S. Pat. Nos. 5,836,122 and 5,613,335, both to Rennich et al., propose a paperbead for protecting drywall corners containing a paper strip bonded to a metal or plastic core. This paper strip is made of stock paper which is uniformly impregnated with latex throughout its thickness which imparts scuffing and abrasion resistance to the paper. However, such paperbead had problems with adhesiveness of the joint compound because of the latex coating on both surfaces of the paperbead.

Rennich et al, as described in U.S. Pat. No. 7,214,434, developed a paperbead with paper where one side of the paper had a strengthening compound penetrating into only a portion of the thickness of the paper, and the other side of the paper was roughened. This provided a paperbead which was resistant to abrasion and had excellent adhesiveness to joint compounds. The latex impregnated side of the paper maintained increased strength making the paper resistant to scuffing, while at the same time, the roughened side of the paper improved its adhesiveness to joint compounds.

It is not uncommon that the surface of drywall adjacent to its edge may have a significant non-planar contour, being rough, uneven, undulating or otherwise warped. These conditions may arise for example as a result of damage in handling or installing the drywall. For example, one or more drywall nails or screws attaching the drywall to the underlying framing may have been angled or recessed too far into the drywall or too close to the drywall edge, causing depressions and unevenness. There may be deformations due to drywall knife cuts, hammer strikes or other causes resulting in a non-planar contour of the surface of the drywall in a region adjacent or along the edge of the drywall. In conditions where the drywall surface has such non-planar contours, it has been found that there is a possibility of the prior art paperbeads not being able to properly follow and adhere to the non-planar surface of the drywall. This can give rise to the formation of bubbles or edge lifting of the paperbead.

While the above prior art arrangements have been successful in certain environments where the surface of the drywall panels have not been deformed, there is always a push to improve installed fit and finish, so there remains a need for a paperbead which can better follow non-planar contours of the drywall surface.

SUMMARY OF THE INVENTION

In accordance with the present invention, the improved paperbead for use in protecting exposed drywall surfaces having a non-planar surface contour in an edge region adjacent the drywall edges comprises an elongated core having an inner surface and an outer surface, an elongated paper strip having an inner surface and an outer surface, a thickness of between 6 and 7 mils, a weight of between 110 and 125 grams/square Meter (gsm) and a porosity of 30 to 130 Gurley sec., the inner surface of the paper strip being roughened to improve adhesiveness to joint compounds and bonded to the outer surface of the core. The width of the paper strip is greater than the width of the core such that at least one edge of the paper strip extends laterally beyond the edge of the core to form a wing on at least one edge of the paperbead. The outer portion of the thickness of the paper strip is impregnated with a strengthening compound, preferably a polymer strengthening compound, more preferably a latex strengthening compound in an amount between 3.5% and 13% of the total weight of the paper strip.

Another aspect of the invention provides a method for protecting exposed drywall edges where the drywall surface has a non-planar surface contour in an edge region adjacent the drywall edges. The method comprises:

a) providing a paperbead having an elongated core with an inner surface and an outer surface, and an elongated paper strip having an inner surface and an outer surface, a thickness of between 6 and 7 mils, a weight of between 110 and 125 grams/square meter (gsm) and a porosity of 30 to 130 Gurley sec., the inner surface of the paper strip being roughened to improve adhesiveness to joint compounds and bonded to the outer surface of the core. The width of the paper strip is greater than the width of the core such that at least one edge of the paper strip extends laterally beyond the edge of the core to form a wing on at least one edge of the paperbead. The outer portion of the thickness of the paper strip is impregnated with a strengthening compound in an amount between 3.5% and 13% of the total weight of the paper strip b) applying a bonding layer of a joint compound to the edge region of the drywall surface, c) embedding the paperbead into the bonding layer of the joint compound, such that the wing of the paperbead follows the non-planar surface contour in the edge region, d) applying an exterior layer of joint compound to the outer surface of the paperbead extending beyond the wing and the bonding layer, and e) allowing the exterior layer of joint compound to dry followed by sanding and feathering to produce a smooth surface between the drywall and the paperbead.

In a further aspect of the invention, the polymer strengthening compound penetrates only up to about half the thickness of the paper strip.

In another aspect of the invention, the polymer strengthening compound is a latex strengthening compound.

In yet another aspect of the invention, the latex strengthening compound is cross-linked.

In a further aspect of the invention, the inner surface of the paper strip is roughened by mechanical means.

In another aspect of the invention the outer surface of the paper strip in a border region of the wing is lightly roughened or buffed.

In yet another aspect of the invention, the border region extends about 0.5 to about 1 inch from the edge of the paper strip.

In a further aspect of the invention, the paper strip is about 65 mils in thickness, having a weight of about 117 grams/square meter (gsm) and a porosity of about 80 Gurley sec., and the outer portion of the thickness of the paper strip is impregnated with about 8.3% of the total weight of the paper strip of a polymer strengthening compound.

In yet another aspect of the invention, the core has a pair of flanges, the paper strip extending beyond the flanges to form a pair of wings to provide a border region, the border region being roughened.

In a further aspect of the invention, the core is selected from the group consisting of:

a) a center rib and two shoulders interposed between said flanges, said shoulders connecting said center rib and said flanges;

b) a bullnose and a pair of shoulders interposed between said flanges, said shoulders connecting said bullnose to said flanges;

c) a shoulder and an offset rib, said flanges comprising a long flange and a short flange, said short flange having an inner surface, said Shoulder connecting said long flange and said offset rib, said wing extending beyond said short flange bonded to said inner surface of said short flange;

d) a center portion, an offset rib, a first flange and a second flange, said center portion positioned between said offset rib and said second flange, said second flange extending from said center portion, said first flange extending from said offset rib in a direction opposite said second flange;

e) a center portion, a short flange and a long flange, said center portion positioned between said long flange and said short flange to form a J-shape;

f) two strips, said strips positioned so as to form a space between them; or g) two strips, said strips being joined by a living hinge.

In another aspect of the invention, a formulated synthetic emulsion adhesive bonds the paper strip to the core.

BRIEF DESCRIPTION OF DRAWINGS

Preferred embodiments of the present invention are illustrated in the attached drawings in which.

DETAILED DESCRIPTION OF THE PRESENTLY PREFERRED EMBODIMENTS

Figure 1:
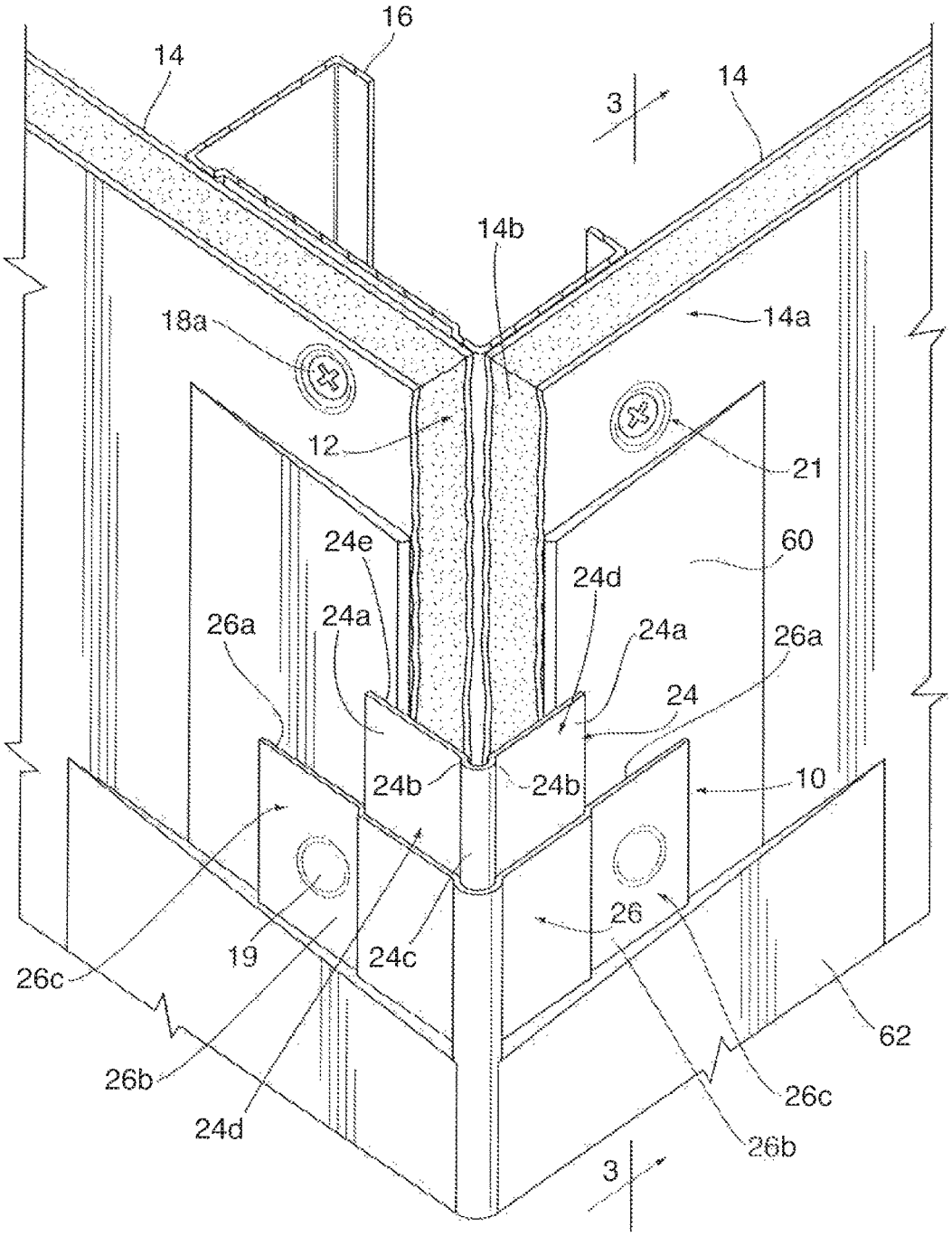
FIG. 1 is a perspective view of an exterior drywall corner with a preferred embodiment of the paperbead for use in the present invention applied thereto and with portions broken away and in section.

The present invention is directed to the use of an improved paperbead for protecting exposed drywall surfaces having a non-planar contour in an edge region adjacent the drywall edges. The improved paperbead is able to follow the non-planar contours of the drywall surface in the edge region to result in an improved installed fit and finish. The paperbead includes an elongated core having an inner surface and an outer surface. The paperbead also includes an elongated paper strip having an inner surface and an outer surface, a thickness of between 6 and 7 mils, having a weight of between 110 and 125 grams/square meter (gsm) and a porosity of 30 to 130 Gurley sec. The inner surface of the paper strip is bonded to the outer surface of the core. The inner surface of the paper strip is also roughened to improve adhesiveness to joint compounds. The paper strip has a width greater than the width of the core such that at least one edge of the paper strip extends laterally beyond an edge of the core to form at least one wing along the edge of the paperbead. The outer portion of the thickness of the paper strip is impregnated with between 3.5% and 13% of the total weight of the paper strip of a strengthening agent, preferably a polymer strengthening agent, more preferably a latex strengthening agent. Preferably a border region of the outer surface of the paper strip along the wing of the paper strip is also roughened. The combination of paper strip properties as described herein results in a paperbead which maintains sufficient strength to keep the paper strip resistant to scuffing, while at the same time, achieving good bonding to joint compounds and allowing the paper strip to follow non-planar contours of the surface of the drywall adjacent the edges. The particular advantages of the use of this paperbead will be set out hereinbelow. Preferred embodiments of the paperbead according to the present invention will now be described.

Referring now to the drawings in detail, preferred embodiments of the paperbead of the present invention are illustrated. In particular, referring to FIGS. 1, 2 and 3, a rib-shape embodiment of the paperbead for use in the invention is illustrated generally indicated by the number 10. A paperbead 10 is shown covering an exposed drywall corner 12 formed by two sheets of drywall 14. The Sheets of drywall 14 are attached to underlying framing member 16 by the use of suitable fasteners such as screws 18. While the embodiments illustrated, in the drawing show metal studs as the framing member 16, it will be appreciated by those skilled in the art that other types of framing members including channels or members constructed of other materials including wood may take the place of the metal stud. Typically, screws 18 are driven through the drywall 14 and into the framing member 16 so that the head 18*a* is below the surface of the drywall 14 to form a depression 21. In some instances, the screws 18 may be installed too deep to result in a deeper depression 21 or may be installed at an angle. During installation of the drywall 14, there may also be other defects which may result in the drywall surface having a non-planar contour in the edge region 14*a*. These defects can include knife cuts 20 or other deformations 22.

Figure 2:
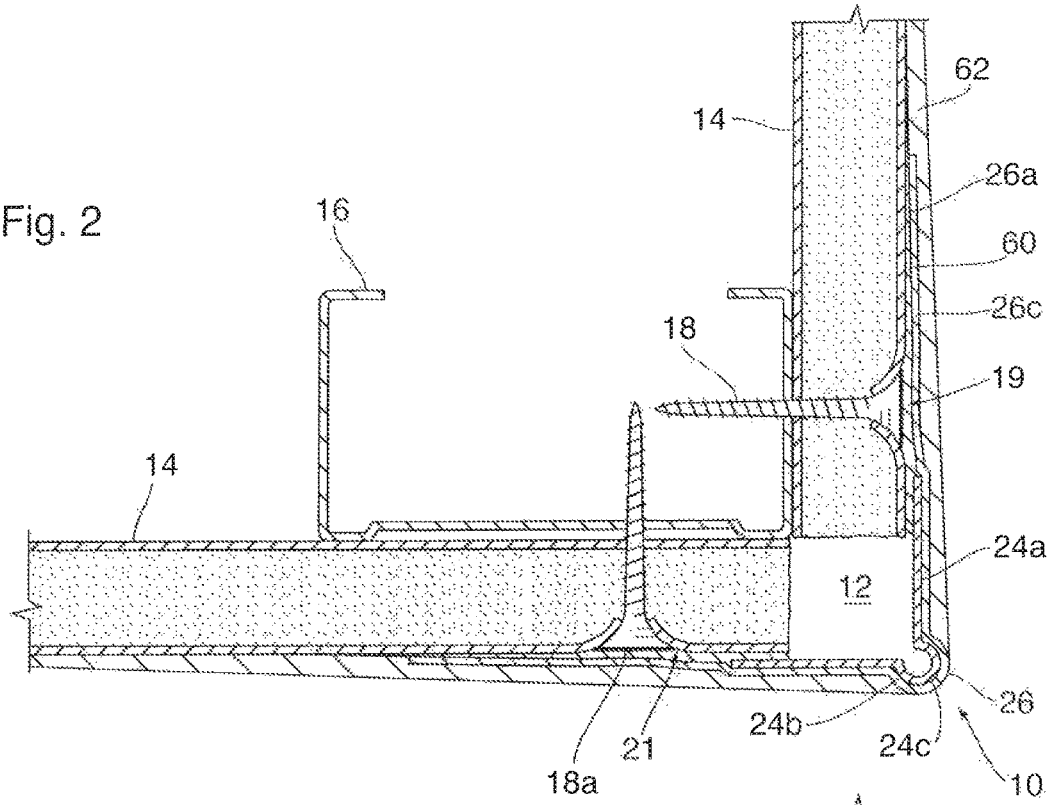
FIG. 2 is a preferred embodiment of the invention showing a horizontal cross section through an exterior corner of FIG. 1.
Figure 3:
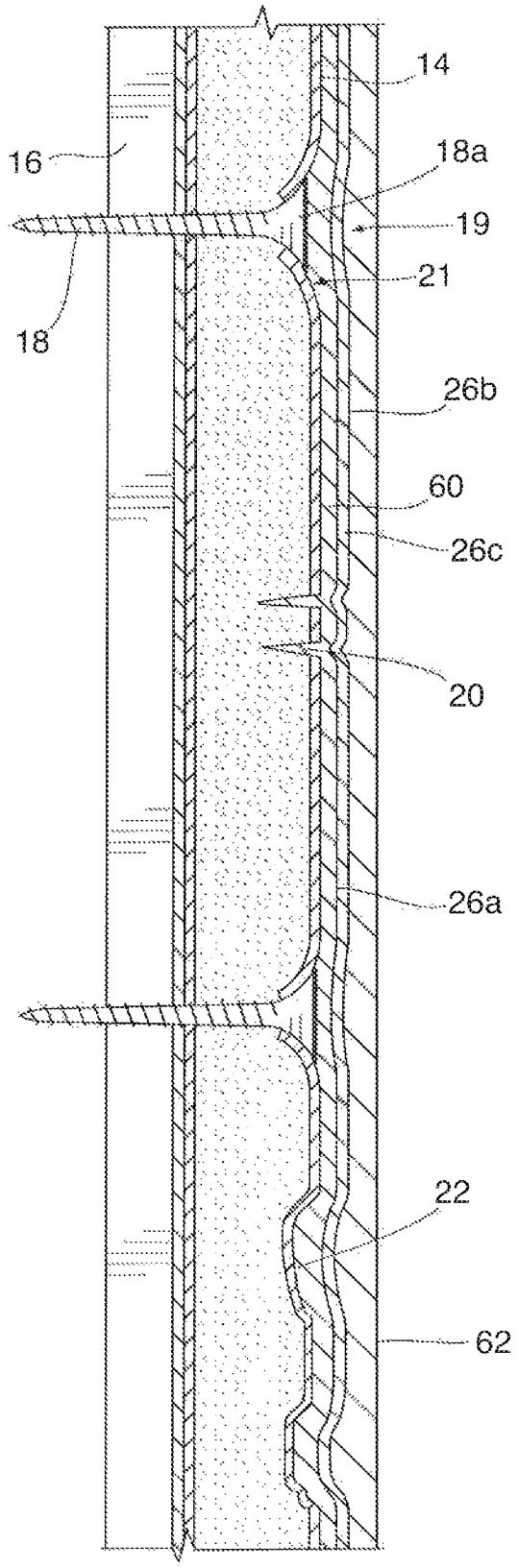
FIG. 3 is a preferred embodiment of the invention showing a vertical cross section through an exterior corner along the line 3-3 of FIG. 1.

The paperbead 10 has an elongated core 24 and an elongated paper strip 26 bonded to the core as shown in FIGS. 1 and 2. The core 24 is preferably made out of metal, such as galvanized steel which meets or exceeds ASTM-C1047 zinc coating specifications. However, other metals or materials such as plastic can function as the core element. In an exemplary embodiment, the core 24 is made of galvanized steel having a thickness of about 0.009 to 0.0150 inches, more preferably 0.0120 to 0.0150 inches. In the rib-shape embodiment of the paperbead, the core 24 is formed into a rib shape having flanges 24*a*, a center rib 24*c* and a pair of shoulders 24*b* connecting the center rib 24*c* and the flanges 24*a*. The core 24 also has an outer surface 24*d* and an inner surface 24*e*. The flanges 24*a* are commonly positioned at an angle of no greater than about 89 degrees relative to each other, but other angular variations may be utilized to accommodate the relative positioning of the drywall sheets 14 and/or the desired shape of the corner. In the rib-shape embodiment shown in FIGS. 1, 2 and 3, the flanges 24*a* are about 1 inch wide. The center rib 24*c* is generally about 0.0625 inches high and 0.125 inches wide.

Figure 4:
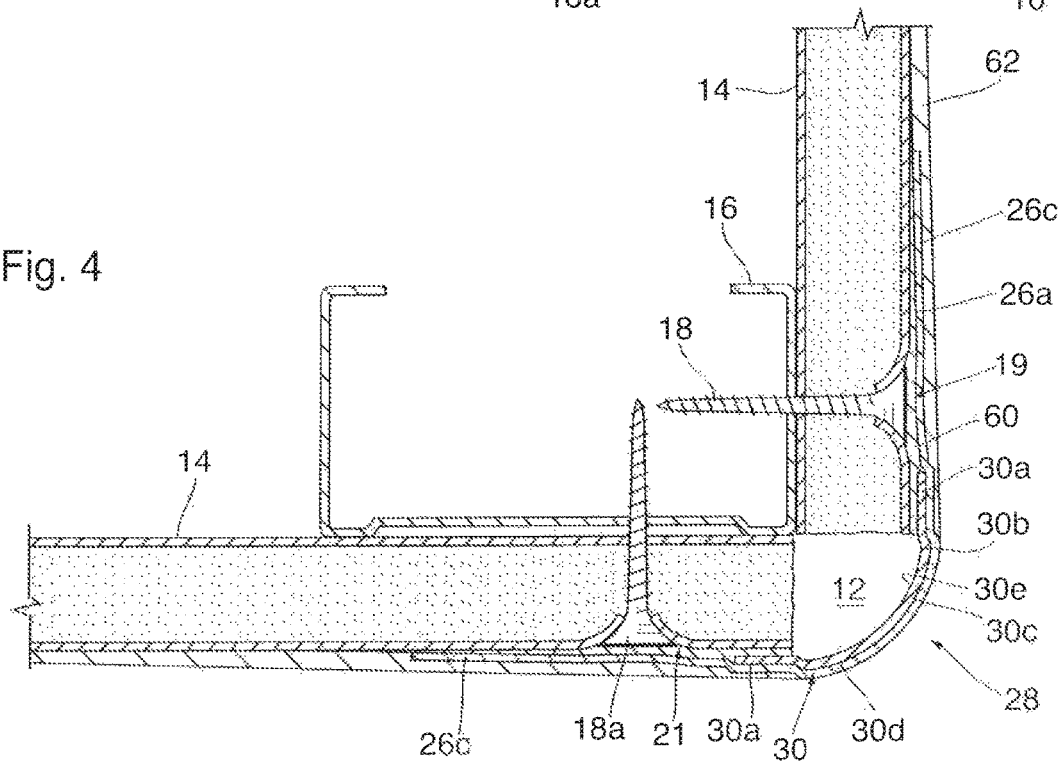
FIG. 4 is a preferred embodiment of the invention showing a cross section through an exterior corner with a Bullnose shape of paperbead applied thereto.
Figure 5:
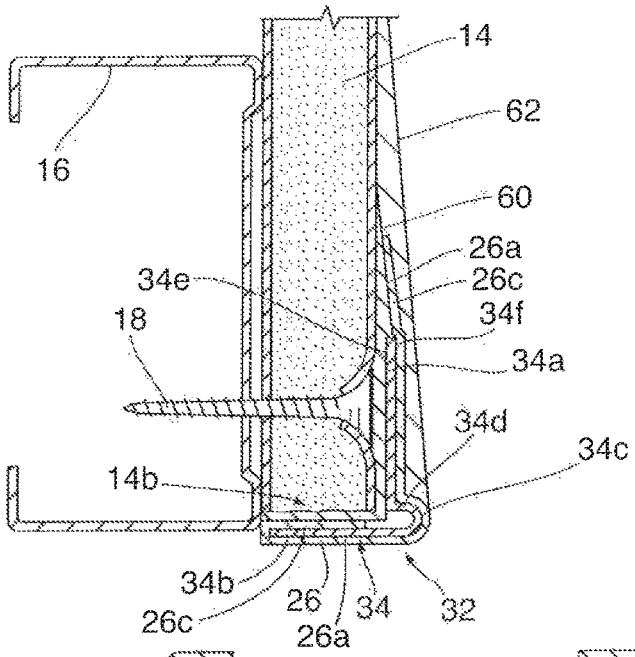
FIG. 5 is a preferred embodiment of the invention showing a cross section through a corner with a L-shape paperbead applied thereto.
Figure 6:
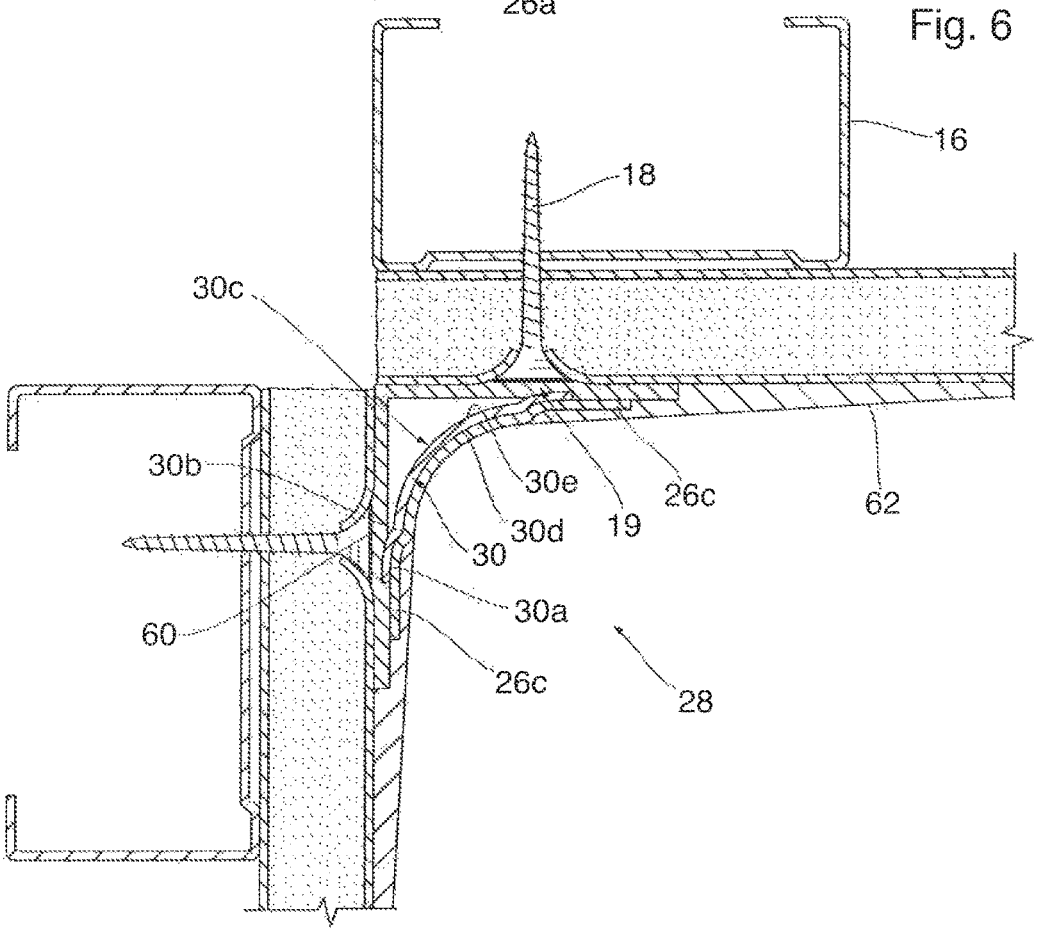
FIG. 6 is a preferred embodiment of the invention showing a cross section through an interior corner with a bullnose shape of corner bead applied thereto.

The paperbead can be used to protect exterior corners, as shown in the embodiments of FIGS. 1 to 5, or to protect interior corners as shown in the FIG. 6 embodiment. For example, FIGS. 4 and 6 illustrate the use of a bullnose shape embodiment paperbead for protecting, respectively, an exterior and interior corner.

A bullnose paperbead 28 has a core 30 having a pair of flanges 30*a*, a bullnose 30*c*, a pair of shoulders 30*b*, an outer surface 30*d* and an inner surface 30*e*. The outer surface 30*d* is defined as that surface facing away from the corner 12, independent of whether that outer surface forms a concave or a convex surface as shown in FIGS. 4 and 6. The flanges 30*d* are generally about 1 inch wide and are positioned, in this embodiment, at an angle of about ninety degrees relative to one another. Other angular variations can be implemented. The radius of the bullnose 30*c* is typically in the range of about 0.5 inches to 1.5 inches. In the preferred embodiment shown, each of the shoulders 30*b* is about 0.125 inches wide and has a drop of 0.0625 from the surface of the bullnose 30*c* to the surface of the flange 30*a*.

A third embodiment of the paperbead for use in the present invention is the shaped paperbead 32 shown in FIG. 5. In this embodiment, the core 34 has a long flange 34*a*, a short flange 34*b*, an offset rib 34*c*, a shoulder 34*d* positioned between the offset rib 34*c* and the long flange 34*a*, an inner surface 34*e* and an outer surface 34*f*. In this embodiment, the long flange 34*a* is about 1.5 inches to 2 inches long, while the short flange 34*b* is about 0.75 inches long. The long flange 34*a* is positioned in this embodiment at no greater than about 89 degrees (per ASTM-C1047) to the short flange 34*b* forming an L-shape. In an exemplary embodiment, the offset rib 34*c* is about 0.0625 inches high and about 0.125 inches wide.

Figure 7:
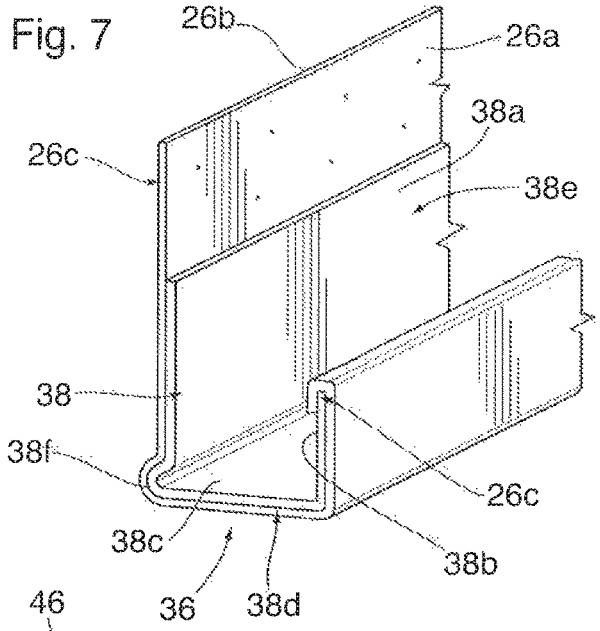
FIG. 7 is a perspective of a preferred embodiment of the invention showing a J-shape type of paperbead.

A fourth embodiment of the paperbead for use in the present invention is the J-shaped paperbead 36 shown in FIG. 7. In this embodiment, the core 38 has a long flange 38*a*, a short flange 38*b*, and a center portion 38*c* positioned between the flanges. The core 38 also has an outer surface 38*d* and an inner surface 38*e*. The long flange 38*a* is typically about 1 inch long. The short flange 38*b* is typically about ½ inches long. The center portion 38*c* is typically about ⅜ inches to ⅝ inches wide. An offset rib 38*f* is also shown in this embodiment as positioned between the center portion 38*c* and the long flange 38*a*. However, the offset rib 38*f* can also be positioned between the center portion 38*c* and the short flange 38*b*. Two offset ribs 38*f* can be provided, one positioned between the center portion 38*c*, and the short flange 38*b*, the other between the centre portion 38*c* and long flange 38*a*. Alternatively, the ribs 38*f* may be excluded all together. In an exemplary embodiment, the offset rib 38*f* is about 0.0625 inches high and about 0.125 inches wide.

Figure 9:
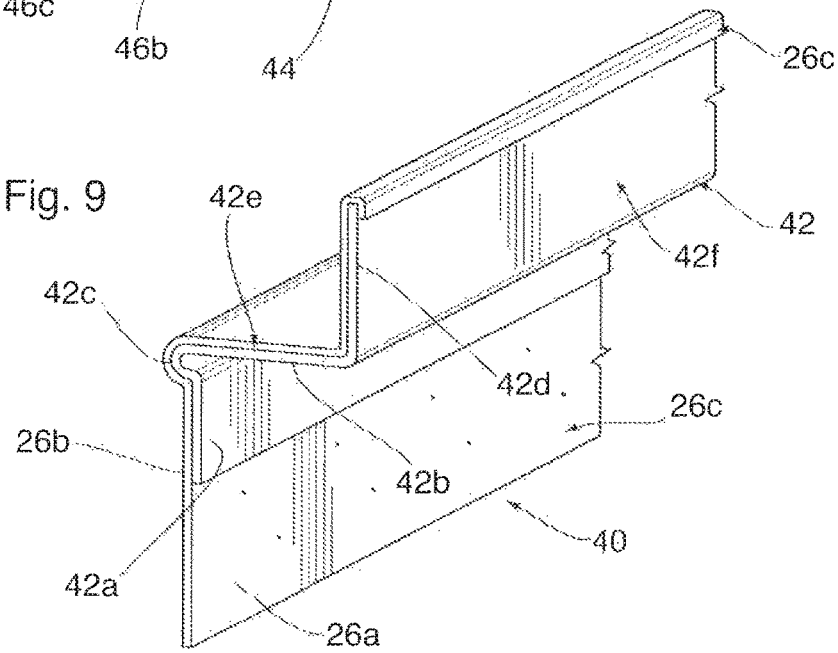
FIG. 9 is a perspective of a preferred embodiment of the invention showing a shadow-mold shape of paperbead.

A fifth embodiment of the paperbead for use in the present invention is the shadow-mold paperbead 40 shown in FIG. 9. In this embodiment, the core 42 has a first flange 42*a*, a second flange 42*d*, a center portion 42*b*, and an offset rib 42*c*. The core 42 also has an outer surface 42*e* and an inner surface 42*f*. The first flange 42*a* extends from the offset rib 42*c* forming an angle of about 90 degrees to the center portion 42*b*. The center portion 42*b* is positioned between the offset rib 42*c* and the second flange 42*d*. The second flange 42*d* extends from the center portion 42*b* at an angle of about 90 degrees in a direction opposite from the first flange 42*a*. In an exemplary embodiment, the flanges 42*a* and 42*d* are generally about ⅜ inches to 1 inch in width, but are not necessarily of equal width. The center portion 42*b* is about ⅜ inches to 1 inch in width.

Figure 8:
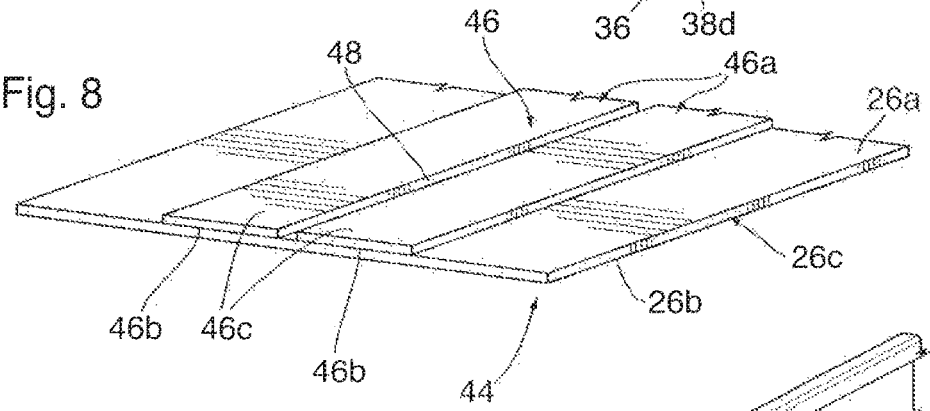
FIG. 8 is a perspective of a preferred embodiment of the invention showing a splays-bead shape of paperbead.

A sixth embodiment of the paperbead for use in the present invention is the splay-bead paperbead 44 shown in FIG. 8. In this embodiment, the core 46 has two strips 46*a* each of which has an outer surface 46*b* and an inner surface 46*c*. In an exemplary embodiment, the strips 46*a* are about ½ inches to ¾ inches in width.

Referring again to FIGS. 1 and 2, an inner surface 26*a* of the paper strip 26 is bonded to the outer surface 24*d* of the core 24. In the rib-shape embodiment, the paper strip 26 extends laterally beyond the edge of each of the core flanges 24*a* about 1 inch to form a pair of wings 26*c*. In a preferred embodiment, a border region 26*d* (see FIGS. 1 and 11) of the outer surface 26*b* along the edge of the paper strip 26 may receive additional processing as described below.

Now referring again to FIG. 5, in making the L-shaped paperbead 32, the wing 26*c* extending beyond the short flange 34*b* is wrapped around the flange and its inner surface 26*a* is bonded to the inner surface 34*e* of the short flange 34*b*.

As shown in FIG. 8, in the splay-bead paperbead 44 embodiment of the invention, the outer surfaces 46*b* of the two core strips 46*a* are bonded to the inner surface 26*a* of the paper strip 26 leaving a space 48 between them. The space 48 may be, for example, 0.050 inches. This spacing allows the strips 46*a* to rotate relative to each other. The strips 46*a*, therefore, can be positioned at different angles relative to each other. Accordingly, the splay-bead paperbead 44 can accommodate a variety of wall angle combinations. In an exemplary embodiment, the paper strip 26 extends beyond the metal strips 46*a* about ¾ inches to 1¼ inches. In another embodiment of the invention, the strips 46*a* are polymer or plastic strips connected one to the other by a living hinge rather than being spaced apart.

In making the J-shaped paperbead 36, the inner surface 26*a* of the paper strip 26 can be bonded to the outer surface 38*d* of the core 38 in a number of ways. For instance, in the embodiment shown in FIG. 7, one wing 26*c* extends beyond the long flange 38*a* about ¾ inches and a second wing 26*c* wraps around the short flange 38*b* about 0.125 inches. In other J-shaped paperbead 36 embodiments, the wings 26*c* may extend beyond or wrap around the long flange 38*a* and short flange 38*c* in any number of combinations.

In the shadow-mold paperbead 40 embodiment, one wing 26*c* extends beyond the first flange 42*a* about ½ inches to 1 inch. The second wing 26*c* wraps around the second flange 42*d* about 0.125 inches as shown in FIG. 9.

Figure 10:
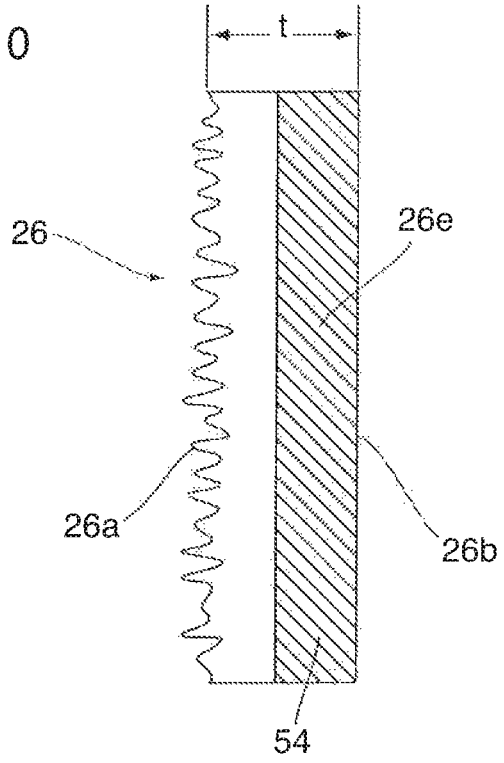
FIG. 10 is cut away view of the paper strip utilized in the paperbead of the present invention.

FIG. 10 shows the paper strip 26 as used in the present invention. The paper strip 26 is made from a stock paper, preferably a softwood and/or hardwood fiber Kraft stock paper. However, synthetic fiber products can also be used. The paper strip is between 6 and 7 mils in thickness, has a weight of between 110 and 125 grams/square meter (gsm), a porosity of between 30 and 130 Gurley sec. and has two surfaces, an outer surface 26*b* and an inner surface 26*a*. The outer portion 26*e* of the thickness of the paper strip 26 is impregnated with between 3.5% and 13% of a strengthening compound 54 based on the weight of the paper strip. Outer portion 26*e* is preferably impregnated about half the thickness t of the paper strip. To obtain high wet and dry strength properties, the strengthening compound is preferably a polymer, more preferably a latex. Generally, a latex consists of a stable colloidal dispersion of a polymeric substance in an aqueous medium. There are a large number of commercial latexes. For example, rubber latexes, including a styrene-butadiene rubber, and resin latexes, including acrylic resins, may be used to impregnate the stock paper strip. The inner surface 26*a* of the paper strip 26 is roughened resulting in a rough and irregular surface pattern.

In a preferred embodiment, the latex is cross-linked. As a result, the paper strip has a good internal bond and exhibits excellent Z-direction tensile strength properties. Cross-linking can be accelerated by heating or superheating the latex impregnated paper strip. The process of impregnating the paper strip and cross-linking the latex does not increase the thickness of the paper strip yet increases its strength properties and its ability to resist abrasion. The paper strip also provides an excellent outer surface 26*b* for paint adhesion.

In a preferred embodiment, paper strip 26 is composed of 100% soft wood pulp formed on a Fourdrinier paper machine. A polyamide wet strength resin is preferably added prior to forming to impart wet strength properties to the sheet. After forming, the sheet is pressed and the dried on conventional dryer cans.

The paper strip 26 is then impregnated with latex in its outer portion 26*e* such that the latex only penetrates about half way through the thickness t of the paper strip. The inner surface 26*a* of paper strip 26 is roughened to obtain a felt-like texture.

Most types of metal paperbeads, exterior and interior, are produced by feeding a roll of paper and a flat metal strip into a paperbead roll former. Preferably, as the paper is being fed into the roll former, the non-impregnated inner surface 26*a* of the paper strip is roughened by an abrasive, granular, or metal wire surface. The metal strip is roll formed into its respective core shape, whether it be a bullnose type, a center rib type, an L-shaped type or any other type of corner bead. Metal cores can also be made by extrusion. As noted previously, plastic cores can also be utilized. In an exemplary embodiment, the paper strip 26 is covered with a hot melt glue on the non-impregnated inner surface 26*a*. For example, several suitable fast-setting hot melt glues are commercially available. This type of glue is typically a formulated synthetic emulsion adhesive. The paper strip is then bonded to the outer surface of the core by applying pressure to the core and the paper strip with a series of pressure rolls to ensure an even bond. The paperbead is then cut to the desired length.

Figure 11:
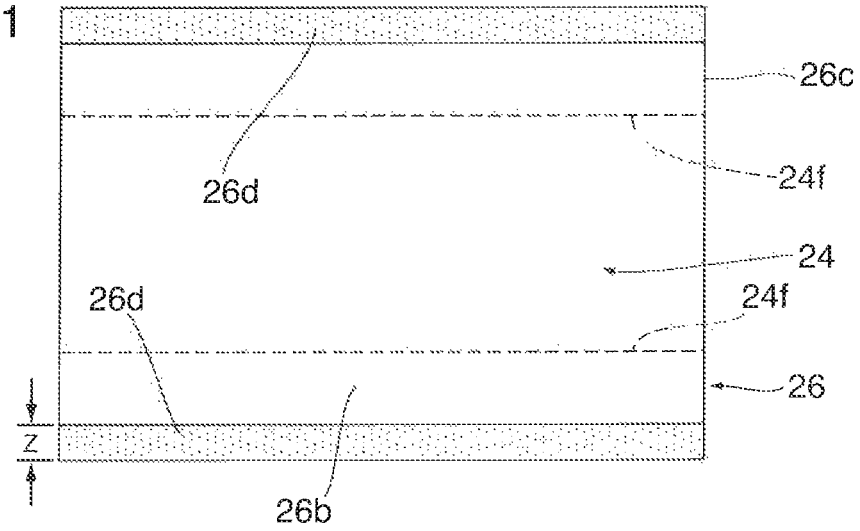
FIG. 11 is a plan view of the latex impregnated side of the paperbead of the invention.

Referring to FIG. 11, in a preferred embodiment, outer surface 26*b* of the paperbead has a border region 26*d* on the outer edges of the paper strip 26. The edges 24*f* of the underlying core 24 are shown in dashed lines. The border region 26*d* is provided with a means for improved bonding with joint compound as is common in the art. This means may include slitting of the paper strip or skiving where the surface is slightly roughened or buffed by an abrasive, granular or metal wire surface. The width z of the border region 26*d* may cover a part or all of the entire wing 26*c*, preferably about 0.5 to about 1 inch, more preferably about 0.6 to about 0.7 inch, and most preferably about 0.625 inch. The purpose of the border region 26*d* is to improve bonding of the paperbead with the exterior layer compound or joint cement to prevent edge cud when the paperbead is applied to walls as described below. Although FIG. 11 shows a generic paperhead similar to that shown in FIG. 1, the border region 26*d* is also applicable to other configurations, such as the bullnose paperbead 28 (FIGS. 4 and 6), L-shaped paperbead 32 (FIG. 5), J-shaped paperbead 36 (FIG. 7), shadow-mold paperbead 40 (FIG. 9), and splay-bead paperbead 44 (FIG. 8).

As shown in FIGS. 1 to 4, a paperbead 10 or 28 is installed by first applying a thin bonding layer 60 of joint compound or joint cement of about 4 inches to 4½ inches wide to the leading edges of two interfacing drywall sheets 14. The corner beads 10 or 28, including the core 24 or 30 and the paper strip wings 26*c* are then firmly embedded in the bonding layer 60. Excess joint compound is removed by wiping the paper strip surface with a finishing knife. As the bonding layer 60 of the joint compound dries, the paperbead 10 or 28 follows the contour of the surface of the drywall 14, particularly the non-planar contours from screw heads 18*a*, knife cuts 20 or other deformations 22. This is best illustrated in FIG. 1, where the paper strip 26 is shown following the non-planar contour 21 from an underlying screw head 18*a* forming a shallow depression 19, and in FIG. 3.

An exterior layer 62 of joint compound is then applied to the top of the paperbead 10 or 28 extending about 8 inches inward on the drywall sheet 14, leaving only a paper covered center rib 24*c* or a paper covered bullnose 30*c* exposed. The exterior layer 62 of joint compound is allowed to dry and is then sanded and feathered to produce a smooth surface between the drywall sheet 14 and the paper covered center rib 24*c* or the paper covered bullnose 30*c*. J-shaped paperbeads 36, shadow-mold paperbeads 40 and splay-bead paperbeads 42 are installed in a similar fashion.

As shown in FIG. 6, an interior paperbead is also installed by embedding a paperbead 28 and paper strip wings 26*c* in a bonding layer 60 of joint compound. After drying, an exterior layer 62 of joint compound is applied, sanded and feathered. Interior bullnose paperbeads 28 will have an exposed paper covered bullnose 30*c*.

FIG. 5 shows an U-shaped paperbead 32 installed by applying a thin bonding layer 60 of joint compound to a drywall sheet 14 and the exposed end 14*b* of the sheet. The L-shaped paperbead 32 is embedded in the bonding layer 60. An exterior layer 62 of joint compound is then applied to cover a paper covered long flange 34*a* and wing 26*c*. This layer is sanded and feathered to provide a smooth and continuous surface between a paper covered offset rib 34*c* and the drywall sheet 14.

In preliminary testing, a paperbead for use in accordance with the present invention was compared with the preferred embodiment of a paperbead produced in accordance with Rennich et al as described in U.S. Pat. No. 7,214,434. The paperbead for use in the present invention utilized a paper strip of about 6.5 mils in thickness, having a weight of about 117 grams/square meter (gsm) and a porosity of about 80 Gurley sec., the outer portion of the thickness of the paper strip being impregnated with about 8.3% of the total weight of the paper strip of a polymer strengthening compound. Both paperbeads were produced to include top side skiving of the border region and met QC specifications. Each of the paperbeads was installed on a test wall with 90 deg corners and tested using ASTM C474 standards and test methods and both paperbeads met the ASTM C475 standard specifications for joint Compound and Joint Tape for finishing Gypsum Board. However, in this testing, it was readily but surprisingly observed that the described paperbead of the present application was following and adhering to non-planar contours of the drywall surface noticeably better than the prior art paperbead. For example, as is illustrated in FIG. 1, when applied over screw head depressions 21, the wings 26*c* of the paperbead 10 adhered very closely to the underlying depressions 21, whereby a significant visible depression 19 was seen in the outer surface of the wings 26*c*. In contrast, no such significant visible depressions could be seen when the prior art paperbead was used. Unexpected improvements noted included more rapid adhesion to the drywall, improved ability of the paperhead to follow the contours and indentations of the drywall, and reduced edge lifting of the paperbead, resulting in a faster, more efficient installation and superior bond to the joint compound.

Similar results were confirmed in blind field tests on job sites conducted with professional drywall trim applicators.

Although the present invention has been described in detail by way of illustration and example, various changes and modifications may be made without departing in any way from the spirit of the invention and scope of the appended claims. In addition, many of the features and dimensions portrayed in the drawings have been exaggerated for the sake of illustration and clarity.

What is claimed is:

1. An improved paperbead for use in protecting exposed drywall surface having a non-planar surface contour in an edge region adjacent drywall edges of the drywall surface, the paperbead comprising an elongated core having an inner and an outer surface, an elongated paper strip having an inner surface and an outer surface, a thickness of between 6 and 7 mils, a weight of between 110 and 125 grams/square meter (gsm) and a porosity of 30 to 130 Gurley sec., the inner surface of the paper strip being roughened and being bonded to the outer surface of the core, the paper strip being of a width greater than the width of the core such that at least one edge of the paper strip extends laterally beyond the edge of the core to form a wing on at least one edge of the paperbead, the outer portion of the thickness of the paper strip being impregnated with a strengthening compound in an amount of between 3.5% and 13% of the total weight of the paper strip.

2. The improved paperbead for use as claimed in claim 1, wherein the strengthening compound penetrates only up to about half the thickness of the paper strip.

3. The improved paperbead for use as claimed in claim 2 wherein the strengthening compound is a latex strengthening compound.

4. The Improved paperbead for use as claimed in claim 3 wherein, the latex strengthening compound is cross-linked.

5. The improved paperbead for use as claimed in claim 4 wherein the inner surface of the paper strip is roughened by mechanical means.

6. The improved paperbead for use as claimed in claim 5 wherein of the outer surface the paper strip in a border region of the wing is lightly roughened or buffed.

7. The improved paperbead for use as claimed in claim 6 wherein the border region extends about 0.5 to about 1 inch from the edge of the paper strip.

8. The improved paperbead for use as claimed in claim 7, wherein the border region extends about 0.625 inch from the edge of the paper strip.

9. The improved paperbead for use as claimed in claim 7 wherein the paper strip is about 6.5 mils in thickness, having a weight of about 117 grams/square meter (gsm) and a porosity of about 80 Gurley sec. the outer portion of the thickness of the paper strip being impregnated with about 8.3% of the total weight of the paper strip of a polymer strengthening compound.

10. The improved paperbead for use as claimed in claim 9 wherein the core has a pair of flanges, the paper strip extending beyond the flanges to form a pair of wings to provide a border region, the border region being roughened.

11. The improved paperbead for use as claimed in claim 9 wherein the core is selected from the group consisting of:

a) a center rib and two shoulders interposed between said flanges, said shoulders connecting said center rib and said flanges;

b) a bullnose and a pair of shoulders interposed between said flanges, said shoulders connecting said bullnose to said flanges;

c) a shoulder and an offset rib, said flanges comprising a long flange and a short flange, said short flange having an inner surface, said shoulder connecting said long flange and said offset rib, said wing extending beyond said short flange bonded to said inner surface of said short flange;

d) a center portion, an offset rib, a first flange and a second flange, said center portion positioned between said offset rib and said second flange, said second flange extending from said center portion, said first flange extending from said offset rib in a direction opposite said second flange;

e) a center portion, a short flange and a long flange, said center portion positioned between said long flange and said short flange to form a J-shape; and f) one of two strips, said strips positioned so as to form a space between them and two strips being joined by a living hinge.

12. The improved paperbead for use as claimed in claim 11 wherein a formulated synthetic emulsion adhesive bonds the paper strip to the core.

13. The use of an improved paperbead for protecting exposed drywall surface having a non-planar surface contour in an edge region adjacent drywall edges of the drywall surface, the improved paperbead comprising an elongated core having an inner and an outer surface, an elongated paper strip having on inner surface and an outer surface, a thickness of between 6 and 7 mils, a weight of between 110 and 125 grams/square meter (gsm) and a porosity of 30 to 130 Gurley sec., the inner surface of the paper strip being roughened and being bonded to the outer surface of the core, the paper strip being of a width greater than the width of the core such that at least one edge of the paper strip extends laterally beyond an edge of the core to form a wing on at least one edge of the paperbead, an outer portion of the thickness of the paper strip being impregnated with a strengthening compound in an amount of between 3.5% and 13% of the total weight of the paper strip.

14. The use of the improved paperbead as claimed in claim 13, wherein the strengthening compound penetrates only up to about half the thickness of the paper strip.

15. The use of the improved paperbead as claimed in claim 14 wherein the strengthening compound is a latex strengthening compound.

16. The use of the improved paperbead as claimed in claim 15 wherein, the latex strengthening compound is cross-linked.

17. The use of the improved paperbead as claimed in claim 16 wherein the inner surface of the paper strip is roughened by mechanical means.

18. The use of the improved paperbead as claimed in claim 17 wherein the outer surface the paper strip in a border region of the wing is lightly roughened or buffed.

19. The use of the improved paperbead as claimed in claim 18 wherein the border region extends about 0.5 to about 1 inch from the edge of the paper strip.

20. The use of the improved paperbead as claimed in claim 19, wherein the border region extends about 0.625 inch from the edge of the paper strip.

21. The use of the improved paperbead as claimed in claim 19 wherein the paper strip is about 6.5 mils in thickness, having a weight of about 117 grams/square meter (gsm) and a porosity of about 80 Gurley sec., an outer portion of the thickness of the paper strip being Impregnated with about 8.3% of the total weight of the paper strip of a polymer strengthening compound.

22. The use of the improved paperbead as claimed in claim 21 wherein the core has a pair of flanges, the paper strip extending beyond the flanges to form a pair of wings to provide a border region, the border region being roughened.

23. The use of the improved paperbead as claimed in claim 21 wherein the core is selected from the group consisting of:

a) a center rib and two shoulders interposed between said flanges, said shoulders connecting said center rib and said flanges;

b) a bullnose and a pair of shoulders interposed between said flanges, said shoulders connecting said bullnose to said flanges;

c) a shoulder and an offset rib, said flanges comprising a long flange and a short flange, said short flange having an inner surface, said shoulder connecting said long flange and said offset rib, said wing extending beyond said short flange bonded to said inner surface of said short flange;

d) a center portion, an offset rib, a first flange and a second flange, said center portion positioned between said offset rib and said second flange, said second flange extending from said center portion, said first flange extending from said offset rib in a direction opposite said second flange;

e) a center portion, a short flange and a long flange, said center portion positioned between said long flange and said short flange to form a J-shape;

f) one of two strips, said strips positioned so as to form a space between them and g) two strips, said strips being joined by a living hinge.

24. The use of the improved paperbead as claimed in claim 23 wherein a formulated synthetic emulsion adhesive bonds the paper strip to the core.

* * * * *